US007457752B2

(12) United States Patent
Oudeyer

(10) Patent No.: US 7,457,752 B2
(45) Date of Patent: Nov. 25, 2008

(54) METHOD AND APPARATUS FOR CONTROLLING THE OPERATION OF AN EMOTION SYNTHESIZING DEVICE

(75) Inventor: Pierre Yves Oudeyer, Paris (FR)

(73) Assignee: Sony France S.A., Clichy (FR)

( * ) Notice: Subject to any disclaimer, the term of this patent is extended or adjusted under 35 U.S.C. 154(b) by 749 days.

(21) Appl. No.: 10/217,002

(22) Filed: Aug. 12, 2002

(65) Prior Publication Data

US 2003/0040911 A1 Feb. 27, 2003

(30) Foreign Application Priority Data

Aug. 14, 2001 (EP) ..... 01402176

(51) Int. Cl.
*G10L 13/00* (2006.01)

(52) U.S. Cl. ..... 704/258; 704/261; 704/268; 704/270; 700/1

(58) Field of Classification Search ..... 700/31, 700/94; 704/258, 270, 261, 268
See application file for complete search history.

(56) References Cited

U.S. PATENT DOCUMENTS 5,367,454 A * 11/1994 Kawamoto et al. ..... 715/706
5,559,927 A * 9/1996 Clynes ..... 704/258
5,732,232 A 3/1998 Brush, II et al.
5,765,134 A * 6/1998 Kehoe ..... 704/270
5,860,064 A * 1/1999 Henton ..... 704/260
6,160,986 A * 12/2000 Gabai et al. ..... 434/308
6,175,772 B1 * 1/2001 Kamiya et al. ..... 700/31
6,185,534 B1 * 2/2001 Breese et al. ..... 704/270
6,804,649 B2 * 10/2004 Miranda ..... 704/258
6,947,893 B1 * 9/2005 Iwaki et al. ..... 704/258
6,959,166 B1 * 10/2005 Gabai et al. ..... 434/308
6,980,956 B1 * 12/2005 Takagi et al. ..... 704/275
2002/0019678 A1 * 2/2002 Mizokawa ..... 700/94
2002/0026315 A1 * 2/2002 Miranda ..... 704/258
2004/0019484 A1 * 1/2004 Kobayashi et al. ..... 704/258

OTHER PUBLICATIONS

Jun Sato, Shigeo Morishima, "Emotion Modeling in Speech Production Using Emotion Space", IEEE, 1996.*

Fumio Kawakami, Shigeo Morishima, Hiroshi Yamada, Hiroshi Harashima, "Construction of 3-D Emotion Space Based on Parameterized Faces", IEEE, 1994.*

(Continued)

*Primary Examiner*—Patrick N. Edouard
*Assistant Examiner*—Eric Yen
(74) *Attorney, Agent, or Firm*—Oblon, Spivak, McClelland, Maier & Neustadt, P.C.

(57) ABSTRACT

Method and apparatus for controlling the operation of an emotion synthesizing device, notably of the type where the emotion is conveyed by a sound, having at least one input parameter whose value is used to set a type of emotion to be conveyed, by making at least one parameter a variable parameter over a determined control range, thereby to confer a variability in an amount of the type of emotion to be conveyed. The variable parameter can be made variable according to a variation model over the control range, the model relating a quantity of emotion control variable to the variable parameter, whereby said control variable is used to variably establish a value of said variable parameter. Preferably the variation obeys a linear model, the variable parameter being made to vary linearly with a variation in a quantity of emotion control variable.

15 Claims, 8 Drawing Sheets

OTHER PUBLICATIONS

Fumio Kawakami, Motohiro Okura, Hiroshi Yamada, Hiroshi Harashima, Shigeo Morishima, "An Evaluation of 3-D Emotion Space", IEEE, 1995.*

Shigeo Morishima, Hiroshi Harashima, "Emotion Space for Analysis and Synthesis of Facial Expression", IEEE, 1993.*

Janet E. Cahn, "The Generation of Affect in Synthesized Speech", Journal of the American Voice I/O Society, 1990.*

Sato J et al: "Emotion modeling in speech production using emotion space" Robot and Human Communication, 1996., 5th IEEE International Workshop on Tsukuba, Japan Nov. 11-14, 1996, New York, NY, USA, IEEE, US, Nov. 11, 1996, pp. 472-477, XP010212883 ISBN: 0-7803-3253-9.

Patent Abstracts of Japan vol. 0165, No. 32 (P-1448), Oct. 30, 1992 & JP 4 199098 A (Meidensha Corp), Jul. 20, 1992.

Yoshinori Kitahara et al: "Prosodic Control to Express Emotions for Man-Machine Speech Interaction" IEICE Transactions on Fundamentals of Electronics, Communications and Computer Sciences, Institute of Electronics Information and Comm. Eng. Tokyo, JP, vol. E75-A, No. 2, Feb. 1, 1992, pp. 155-163, XP000301808 ISSN:0916-8508.

Ignasi Iriondo et al: "Validation of an Acoustical Modelling of Emotional Expression in Spanish Using Speech Synthesis Techniques" ISCA Worksop on Speech and Emotion, Sep. 2000, pp. 1-6, XP007005765.

* cited by examiner

METHOD AND APPARATUS FOR CONTROLLING THE OPERATION OF AN EMOTION SYNTHESIZING DEVICE

BACKGROUND OF THE INVENTION

1. Field of the Invention

The invention relates to the field of emotion synthesis in which an emotion is simulated e.g. in a voice signal, and more particularly aims to provide a new degree of freedom in controlling the possibilities offered by emotion synthesis systems and algorithms.

In the case of an emotion to be conveyed on voice data, the latter can be intelligible words or unintelligible vocalisations or sounds, such as babble or animal-like noises.

Such emotion synthesis finds applications in the animation of communicating objects, such as robotic pets, humanoids, interactive machines, educational training, systems for reading out texts, the creation of sound tracks for films, animations, etc., among others.

2. Discussion of the Background

FIG. 1 illustrates the basic concept of a classical voiced emotion synthesis system 2 based on an emotion simulation algorithm.

The system receives at an input 4 voice data Vin, which is typically neutral, and produces at an output 6 voice data Vout which is an emotion-tinted form of the input voice data Vin. The voice data is typically in the form of a stream of data elements each corresponding to a sound element, such as a phoneme or syllable. A data element generally specifies one or several values concerning the pitch and/or intensity and/or duration of the corresponding sound element. The voice emotion synthesis operates by performing algorithmic steps modifying at least one of these values in a specified manner to produce the required emotion.

The emotion simulation algorithm is governed by a set of input parameters P1, P2, P3, . . . , PN, referred to as emotion-setting parameters, applied at an appropriate input 8 of the system 2. These parameters are normally numerical values and possibly indicators for parameterising the emotion simulation algorithm and are generally determined empirically.

Each emotion E to be portrayed has its specific set of emotion-setting parameters. In the example, the values of the emotion-setting parameters P1, P2, P3, . . . , PN are respectively C1, C2, C3, . . . , CN for calm, A1, A2, A3, . . . , AN for angry, H1, H2, H3, . . . , HN for happy, S1, S2, S3 . . . , SN for sad.

There also exist emotion simulation algorithm systems that are entirely generative, inasmuch as they do not convert an input stream of voice data, but generate the emotion-tinted voice data Vout internally. These systems also use sets of parameters P1, P2, P3, . . . , PN analogous to those described above to determine the type of emotion to be generated.

Whatever the emotion simulation algorithm system, while these parameterisations can effectively synthesize the corresponding emotions, there is a need in addition to be able to associate a magnitude to a synthesized emotion E. For instance, it is advantageous to be able to produce for a given emotion E a range of quantity of emotion portrayed in the voice data Vout, e.g. from mild to intense.

One possibility would be to create empirically-determined additional sets of parameters for a given emotion, each corresponding to a degree of emotion portrayed. However, such an approach suffers from important drawbacks:

the elaboration of the additional sets would be extremely laborious, their storage in an application would occupy a portion of memory that could be penalizing in a memory-constrained device such as a small robotic pet, the management and processing of the additional sets consume significant processing power, and, from the point of view of performance, it would not allow to envisage embodiments that create smooth changes in the quantity of emotion.

SUMMARY OF THE INVENTION

In view of the foregoing, the invention proposes, according to a first aspect, a method of controlling the operation of an emotion synthesizing device having at least one input parameter whose value is used to set a type of emotion to be conveyed, characterized in that it comprises a step of making at least one parameter a variable parameter over a determined control range, thereby to confer a variability in an amount of the type of emotion to be conveyed.

In a typical application, the synthesis is the synthesis of an emotion conveyed on a sound.

Preferably, at least one variable parameter is made variable according to a local model over the control range, the model relating a quantity of emotion control variable to the variable parameter, whereby the quantity of emotion control variable is used to variably establish a value of the variable parameter.

The local model can be based on the assumption that while different sets of one or several parameter value(s) can produce different identifiable emotions, a chosen set of parameter value(s) for establishing a given type of emotion is sufficiently stable to allow local excursions from the parameter value(s) without causing an uncontrolled change in the nature of the corresponding emotion. As it turns out, the change is in the quantity of the emotion. The determined control range will then be within the range of the local excursions.

The model is advantageously a locally linear model for the control range and for a given type of emotion, the variable parameter being made to vary linearly over the control range by means of the quantity of emotion control variable.

In a preferred embodiment, the quantity of emotion control variable (δ) modifies the variable parameter in accordance with a relation given by the following formula:

$$VPi=A+\delta.B$$

where:

VPi is the value of the variable parameter in question,

A and B are values admitted by the control range, and

δ is the quantity of emotion control variable.

Preferably, A is a value inside the control range, whereby the quantity of emotion control variable is variable in an interval which contains the value zero.

The value of A can be substantially the mid value of the control range, and the quantity of emotion control variable can be variable in an interval whose mid value is zero.

The quantity of emotion control variable is preferably variable in an interval of from −1 to +1.

In the preferred embodiment, the value B is determined by:B=(Eimax−A), or by B=(Eimin+A), where:

Eimax is the value of the input parameter for producing the maximum quantity of the type of emotion to be conveyed in the control range, and Eimin is the value of the parameter for producing the minimum quantity of the type of emotion to be conveyed in the control range.

The value A can be equal to the standard parameter value originally specified to set a type of emotion to be conveyed.

The value Eimax or Eimin can be determined experimentally by excursion of the standard parameter value originally specified to set a type of emotion to be conveyed and by determining a maximum excursion in an increasing or decreasing direction yielding a desired limit to the quantity of emotion to be conferred by the control range.

The invention makes it possible to use a same quantity of emotion control variable to collectively establish a plurality of variable parameters of the emotion synthesizing device.

According to a second aspect, the invention relates to an apparatus for controlling the operation of an emotion synthesizing system, the latter having at least one input parameter whose value is used to set a type of emotion to be conveyed, characterized in that it comprises variation means for making at least one parameter a variable parameter over a determined control range, thereby to confer a variability in an amount of the type of emotion to be conveyed.

The optional features of the invention presented above in the context of the first aspect (method) are applicable mutatis mutandis to the second aspect (apparatus), and shall not be repeated for conciseness.

According to a third aspect, the invention relates to the use of the above apparatus to adjust a quantity of emotion in a device for synthesizing an emotion conveyed on a sound.

According to a fourth aspect, the invention relates to a system comprising an emotion synthesis device having at least one input for receiving at least one parameter whose value is used to set a type of emotion to be conveyed and an apparatus according to third aspect, operatively connected to deliver a variable to the at least one input, thereby to confer a variability in an amount of a type of emotion to be conveyed.

According to a fifth aspect, the invention relates to a computer program providing computer executable instructions, which when loaded onto a data processor causes the data processor to operate the above method. The computer program can be embodied in a recording medium of any suitable form.

BRIEF DESCRIPTION OF THE DRAWINGS

The invention and its advantages shall become more apparent from reading the following description of the preferred embodiments, given purely as non-limiting examples with reference to the appended drawings in which.

DESCRIPTION OF THE PREFERRED EMBODIMENTS

Figure 1:
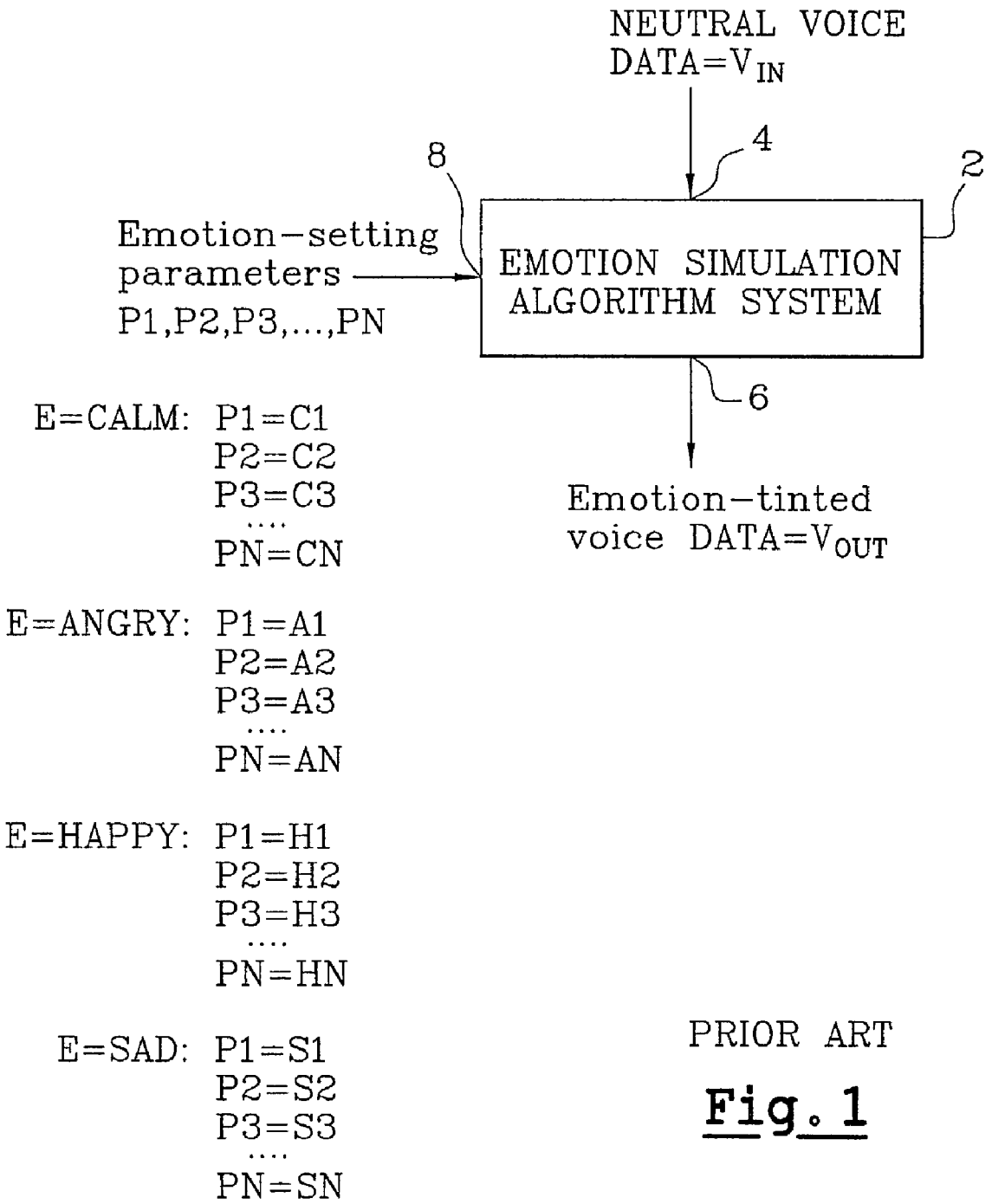
PRIOR ART Fig. 1
FIG. 1, already described, illustrates a classical emotion simulation algorithm system of the type which converts neutral voice data.
Figure 2:
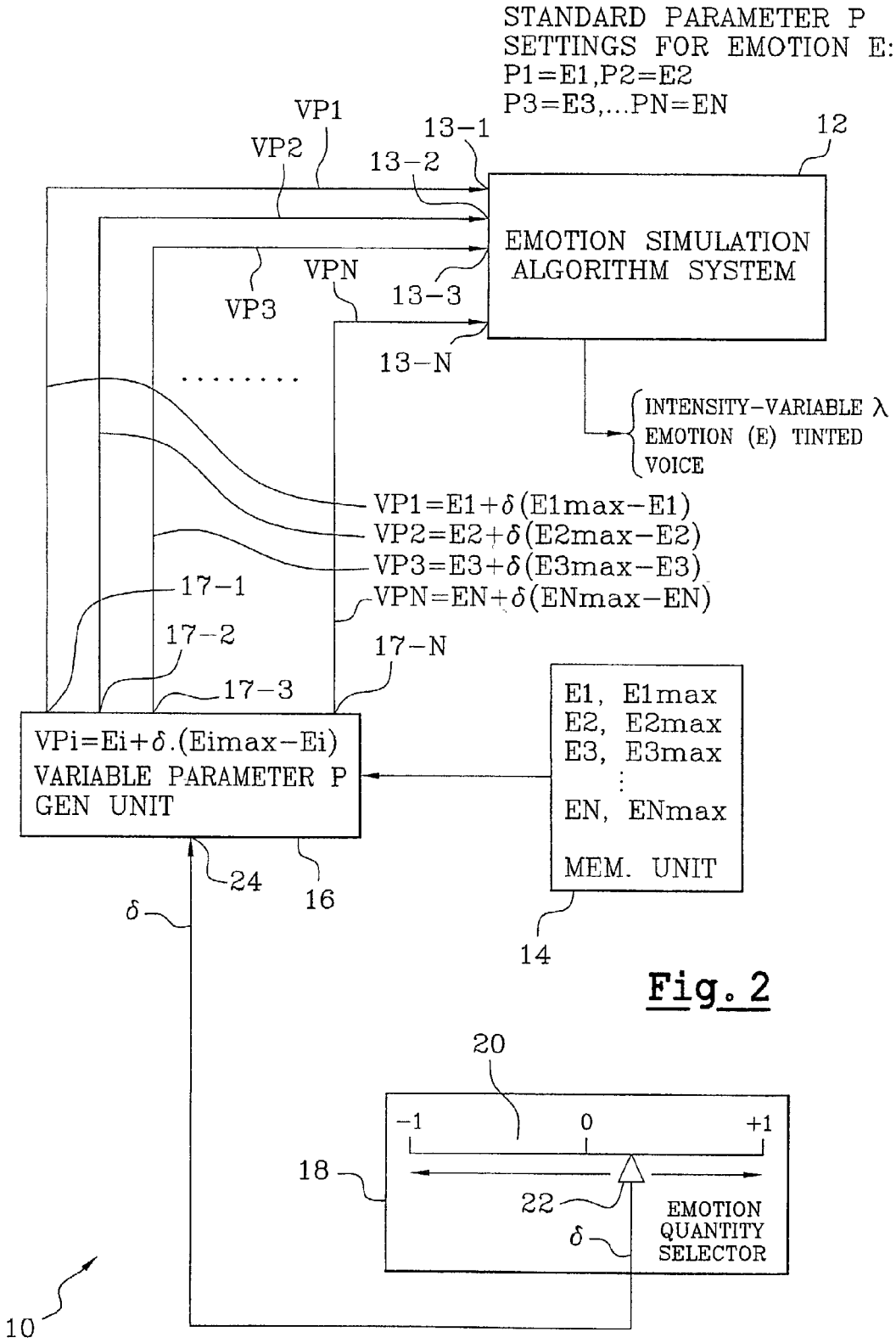
FIG. 2 is a bloc diagram of a quantity of emotion variation system according to a preferred embodiment invention.

FIG. 2 illustrates the functional units and operation of a quantity of emotion variation system 10 according to a preferred embodiment invention, operating in conjunction with a voice-based emotion simulation algorithm system 12. In the example, the latter is of the generative type, i.e. it has its own means for generating voice data conveying a determined emotion E. The embodiment 10 can of course operate equally well with any other type of emotion simulation algorithm system, such as that described with reference to FIG. 1, in which in a stream of neutral voice data is supplied at an input. Both these types of emotion simulation algorithm systems, as well as others with which the embodiment can operate, are known in the art. More information on voice-based emotion simulation algorithms and systems can be found, inter alia, in : Cahn, J. (1990) "The generation of affect in synthesized speech", Journal of the I/O Voice American Society, 8:1-19; Iriondo I., et al (2000) "Validation of an acoustical modeling of emotional expression in Spanish using speech synthesis techniques", Proceedings of ISCA workshop on speech an emotion; Edington Md. (1997) "Investigating the limitations of concatenative speech synthesis", Proceedings of Euro-Speech '97, Rhodes, Greece; Iida A., et al (2000) "A speech synthesis system with emotion for assisting communication", ISCA workshop on speech and emotion.

Also, emotion synthesis methods and devices are described in the following two copending European patent applications of the Applicant, from which the present application claims priority: European Applications No. 01 401 203.3 filed on May 11, 2001 and No. 01 401 880.8 filed on 13 Jul. 2001.

The emotion simulation algorithm system 12 uses a number N of emotion-setting parameters P1, P2, P3, . . . , PN (generically designated P) to produce a given emotion E, as explained above with reference to FIG. 1. The number N of these parameters can vary considerably from one algorithm to another, typically from 1 to 16 or considerably more. These parameters P are empirically-determined numerical values or indicators exploited in calculation or decision steps of the algorithm. They can be loaded into the emotion simulation algorithm system 12 either through a purpose designed interface or by a parameter-loading routine. In the example, the insertion of the parameters P is shown symbolically by lines entering the system 12, a suitable interface or loading unit being integrated to allow these parameters to be introduced from the outside.

The emotion simulation algorithm system 12 can thus produce different types of emotions E, such as calm, angry, happy, sad, etc. by a suitable set of N values for the respective parameters P1, P2, P3, . . . , PN. In the case considered, the system 12 is initially programmed for the following parameterisation: P1=E1, P2=E2, P3=E3, . . . PN=EN to produce a given emotion E, the values E1-EN being already found to yield the emotion E.

The quantity of emotion variation system 10 operates to impose a variation on these values E1-EN according to linear model. In other words, it is assumed that a linear—or progressive—variation of E1-EN causes a progressive variation in the response of the emotion simulation algorithm system 12. As discovered remarkably by the Applicant, the response in question will be a variation in the quantity, i.e. intensity, of the emotion E, at least for a given variation range of the values E1-EN.

In order to produce the above variations in E1-EN, a range of possible variation for each of these values is initially determined. For a given parameter Pi (i being an arbitrary integer between 1 and N inclusive), an exploration of the emotion simulation algorithm system 12 is undertaken, during which a parameter Pi is subjected to an excursion from its initial standard value Ei to a value Eimax which is found to correspond to a maximum intensity of the emotion E. This value Eimax is determined experimentally. It will generally correspond to a value above which that parameter either no longer contributes to a significant increase in the intensity of the emotion E (i.e. a saturation occurs), or beyond which the type of emotion E becomes modified or distorted. It will be noted that the value Eimax can be either greater than or less than the standard value Ei: depending on the parameter Pi, the increase in the intensity of the emotion can result from increasing or decreasing the stand value Ei.

The determination of the maximum intensity value Eimax for the parameter Pi can be performed either by keeping all the other parameters at the initial standard value, or by varying some or all of the others according to a knowledge of the interplay of the different parameters P1-PN.

The above procedure obeys a local model of controllable behavior around the standard parameter values Pi, the latter being assumed to be sufficiently stable to allow local excursions from its initially chosen value to yield a controlled change within the emotion to which it is associated. The determined control range will then be within the range of the local excursions.

After this initial setting up phase, there is obtained a set of maximum intensity parameter values E1max, E2max, E3max, . . . , ENmax, each corresponding to the maximum intensity of the emotion E produced by the respective parameter P1, P2, P3, . . . , PN. These maximum intensity parameter values are stored in a memory unit 14 in association with the corresponding standard initial parameter value Ei. Thus, for a parameter Pi, the memory unit 14 associates two values: Ei and Eimax. In a typical application, the above procedure is performed for each type of emotion E to be produced by the emotion simulation algorithm unit 12, and for which a quantity of that emotion needs to be controlled, each emotion E having associated therewith its respective set of values Ei and Eimax stored in the memory unit 14.

The values stored in the memory unit 14 are exploited by a variable parameter generator unit 16 whose function is to replace the parameters P1-PN of the emotion simulation algorithm system 12 by corresponding variable parameters VP1-VPN.

The variable parameter generator unit 16 generates each variable parameter VPi on the basis of a common control variable and of the associated values Ei and Eimax according to the following formula:

$$VPi=Ei+\delta.(Eimax-Ei) \quad (1).$$

It can be observed that this equation follows a linear model with a standard form y=mx+c, y being VPi, m being (Eimax−Ei), x being δ, and c being Ei.

The variable parameter values VP1-VPN thus produced by the variable parameter generator unit 16 are delivered at respective outputs 17-1 to 17-N which are connected to respective parameter accepting inputs 13-1 to 13-N of the emotion simulation algorithm system 12. Naturally, the schematic representation of these connections from the variable parameter generator unit 16 to the emotion simulation algorithm system 12 can be embodied in any suitable form: parallel or serial data bus, wireless link, etc. using any suitable data transfer protocol. The loading of the variable parameters VP can be controlled by a routine at the level of the emotion simulation algorithm system 12.

The control variable δ is the range of −1 to +1 inclusive. Its value is set by an emotion quantity selector unit 18 which can be a user-accessible interface or an electronic control unit operating according to a program which determines the quantity of emotion to be produced, e.g. as a function an external command indicating that quantity, or automatically depending on the environment, the history, the context, etc. of operation e.g. of a robotic pet or the like.

In the figure, the range of variation of δ is illustrated as a scale 20 along which a pointer 22 can slide to designate the required value of δ in the interval [−1,1]. In a case where the quantity of emotion is controllable by a user, the scale 20 and pointer 22 can be embodied through a graphic interface so as to be displayed as a cursor on a monitor screen of a computer, or forming part of a robotic pet. The pointer 22 can then be displaceable through a keyboard, buttons, a mouse or the like. The scale can also be defined by a potentiometer or similar variable component.

The values of δ can be to all intents and purposes continuous or stepwise incremental over the range [−1,+1].

The value of δ designated by the pointer 20 is generated by an emotion quantity selector unit 18 and supplied to an input 22 of the variable parameter generator unit 16 adapted to receive the control variable so as to enter it into formula (1) above.

The use of a scale normalised in the interval [−1,+1] is advantageous in that it simplifies the management of the values used by the variable parameter generator unit 16. More specifically, it allows the values of the memory unit 14 to be used directly as they are in formula (1), without the need to introduce a scaling factor. However, other intervals can be considered for the range of δ, including ranges that are asymmetrical with respect to the δ=0 position (for which formula (1) returns the standard parameter setting VPi=Ei). The implementation of formula (1) allows to sweep through all the range of variable parameter VPi values from a minimum emotion intensity value Eimin=2Ei−Eimax (case of δ=−1) to Eimax (case of δ=+1). This numerical value for Eimin has been found to be in keeping with the expected range of quantity of emotion that can be controlled through such a linear model based approach. In other terms, it has been found that the thus-obtained value of Eimin does indeed correspond to acceptable lowest level of emotion to be conveyed, with a standard parameter setting Ei (corresponding to δ=0) effectively giving the impression of being a substantially mid-range quantity of emotion setting. However, it can be envisaged to choose an arbitrary mid range value Emr not necessarily equal to Ei. Formula (1) would then be given more generally as VPi=Emr+δ.(Eimax−Emr).

The embodiment is remarkable in that the same variable δ serves for varying each of the N variable parameter values VPi for the emotion simulation algorithm system 12, while covering the respective ranges of values for the parameters P1-PN.

It will be noted that the variation law according to formula (1) is able to manage both parameters whose value needs to be increased to produce an increased quantity of emotion and parameters whose value needs to be decreased to produce an increased quantity of emotion. In the latter case, the value Eimax in question will be less than Ei. The bracketed term of formula (1) will then be negative with a magnitude which increases as the quantity of emotion chosen through the variable δ increases in the region between 0 and +1 . For an increasing magnitude negative δ, the term δ(Eimax−Ei) will be positive and contribute to increasing VPi and thereby to reduce the quantity the emotion.

Moreover, for all values of δ, the variable parameters VP will each have the same relative position in their respective range, whereby the variation produced by the emotion quantity selector 14 is well balanced and homogeneous throughout variable parameters.

Naturally, the embodiment allows for many variants, including:

the number of parameters P made as variable parameters VP. It can be envisaged that not all the N parameters P be controlled, but only a subset of one parameter or more be accessed by the variable parameter generator unit 16, the others remaining at their standard value;

the choice of formula (1), both in its form and values. The choice of constants Ei and Eimax in formula (1) is advantageous in that Ei is already known a priori and Eimax is simply the value determined experimentally, which greatly simplifies the implementation. However, other arithmetic operations using these values or other values can be envisaged. For instance, formula (1) can be adapted to accommodate for an Eimin value which is determined independently, and not subordinated to the value of Eimax. In this case, the formula (1) can be re-expressed as:

$$VPi=Ei+\delta.(Ei\min+Ei) \quad (1').$$

The value of Eimin can be determined experimentally for each parameter to be made variable in a manner analogous to as described above: Eimin is identified as the value which yields the lowest useful amount of emotion, below which there is either no practically useful lowering of emotional intensity or there is a distortion in the type of emotion. The memory will then store values Eimin instead of Eimax.

Also, the mid range value can be a value different from the standard value Ei.;

the choice of the control δ and its interval, as discussed above. Also, other more complex variants can be envisaged which use more than one controllable variable;

the choice of emotion simulation algorithm, as discussed above. Indeed, it will be appreciated that the teachings of the invention are quite universal as regards the emotion simulation algorithms. These teachings can also be envisaged mutatis mutandis for other simulation systems, for instance to create variability to parameters that govern facial expressions to express speech, emotions, etc.

The teachings given above are applicable to all the emotions E simulated by emotion simulation algorithms: calm, happy, angry, sad, anxious, etc.

There shall now be given two examples too illustrate how an emotion simulation algorithm system can benefit from a quantity of emotion variation system 10 as described with reference to FIG. 2.

EXAMPLE 1 a robotic pet able to express by modulated sounds produced by a voice synthesiser which has a set of input parameters defining an emotional state to be conveyed by the voice.

The example is based on the contents of the Applicant's earlier applications No. 01 401 203.3, filed on May 11, 2001 "Method and apparatus for voice synthesis and robot apparatus", from which priority is claimed.

The emotion synthesis algorithm is based on the notion that an emotion can be expressed in a feature space consisting of an arousal component and a valence component. For example, anger, sadness, happiness and comfort are represented in particular regions in the arousal-valence feature space.

The algorithm refers to tables representing a set of parameters P, including at least the duration (DUR), the pitch (PITCH), and the sound (VOLUME) of a phoneme defined in advance for each basic emotion. These parameters are numerical values or states (such as "rising" or "falling"). These state parameters can be kept as per the standard setting and not be controlled by the quantity of emotion variation system 10.

Table I below is an example of the parameters and their attributed values for the emotion "happiness". The named parameters apply to unintelligible words of one or a few syllables or phonemes, specified inter alia in terms of pitch characteristics, duration, contour, volume, etc., in recognized units. These characteristics are expressed in a formatted data structure recognized by the algorithm.

TABLE I parameter settings for the emotion "happiness"

| characteristic value or state | Parameter:numerical |
|---|---|
| Last word accentuated | true |
| Mean pitch | 400 Hz |
| Pitch variation | 100 Hz |
| Maximum pitch | 600 Hz |
| Mean duration | 170 milliseconds |
| Duration variation | 50 milliseconds |
| Probability of accentuating a word | 0.3 (30%) |
| Default contour | rising |
| Contour of last word | rising |
| Volume | 2 (specific units) |

Different emotions will have their own parameter values or states for these same characteristics.

Table II illustrates parameter values for five different emotions.

TABLE II

Parameter Values for Different Emotions

| | Calm | Anger | Sadness |
|---|---|---|---|
| LASTWORDACCENTED | NIL | NIL | NIL |
| MEANPITCH | 280 | 450 | 270 |
| PITCHVAR | 10 | 100 | 30 |
| MAXPITCH | 370 | 100 | 250 |
| MEANDUR | 200 | 150 | 300 |
| DURVAR | 100 | 20 | 100 |
| PROBACCENT | 0.4 | 0.4 | 0 |
| DEFAULTCONTOUR | RISING | FALLING | FALLING |
| CONTOURLASTWORD | RISING | FALLING | FALLING |
| VOLUME | 1 | 2 | 1 |

| | Comfort | Happiness |
|---|---|---|
| LASTWORDACCENTED | TRUE | TRUE |
| MEANPITCH | 300 | 400 |
| PITCHVAR | 50 | 100 |
| MAXPITCH | 350 | 600 |
| MEANDUR | 300 | 170 |
| DURVAR | 150 | 50 |
| PROBACCENT | 0.2 | 0.3 |
| DEFAULTCONTOUR | RISING | RISING |
| CONTOURLASTWORD | RISING | RISING |
| VOLUME | 2 | 0 |

The robotic pet incorporating this algorithm is made to switch from one set of parameter values to another following the emotion it decides to portray.

In this case, the parameters of the characteristics in table I which have numerical values are no longer fixed for a given emotion but become variable parameters VP using the quantity of emotion variation system 10.

For instance, in the case of the mean pitch characteristic for the emotion "happiness", the standard parameter value of 400 (Hz) becomes the value Ei in equation (1) for that parameter. There is performed a step of determining i) in which direction (increase/decrease) this value can be modified to produce a more intense portrayal of the happiness. Then there is performed a step ii) of determining how far in that direction this parameter can be changed to usefully increase this intensity. This limit value is Eimax of equation (1). In this way, there is obtained all the necessary information for creating the variability scale for the variable parameter VPi of that characteristic. The same procedure is applied to all the other characteristics for which it is decided to make the parameter a variable parameter VP by the quantity of emotion variation system 10.

EXAMPLE 2 a system able to add an emotion content to incoming voice data corresponding to intelligible words or unintelligible sounds in a neutral tone, so that the added emotion can be sensed when the thus-processed voice data is played.

The example is based on the contents of the Applicant's earlier application No. 01 401 880.8, filed on Jul. 13, 2001 "Method and apparatus for synthesizing an emotion conveyed on a sound", from which priority is also claimed.

The system comprises an emotion simulation algorithm system which, as in the case of FIG. 1, has an input for receiving sound data and an output for delivering the sound data in the same format, but with modified data values according the emotion to be conveyed. The system can thus be effectively placed along a chain between a source of sound data and a sound data playing device, such as an interpolator plus synthesiser, in a completely transparent manner.

The modification of the data values is performed by operators which act on the values to be modified. Typically, the sound data will be in the form of successive data elements each corresponding to sound element, e.g. a syllable or phoneme to be played by a synthesiser. A data element will specify e.g. the duration of the sound element, and one or several pitch value(s) to be present over this duration. The data element may also designate the syllable to be reproduced, and there can be associated an indication as to whether or not that data element can be accentuated. For instance, a data element for the syllable "be" may have the following data structure: "be: 100, P1, P2, P3, P4, P5". The first number, 100, expresses the duration in milliseconds. The following five values (symbolized by P1-P5) indicate the pitch value (F0) at five respective and successive intervals within that duration.

Different types possible operators of the system produce different modifications on the data elements to which they are applied.

Figure 3:
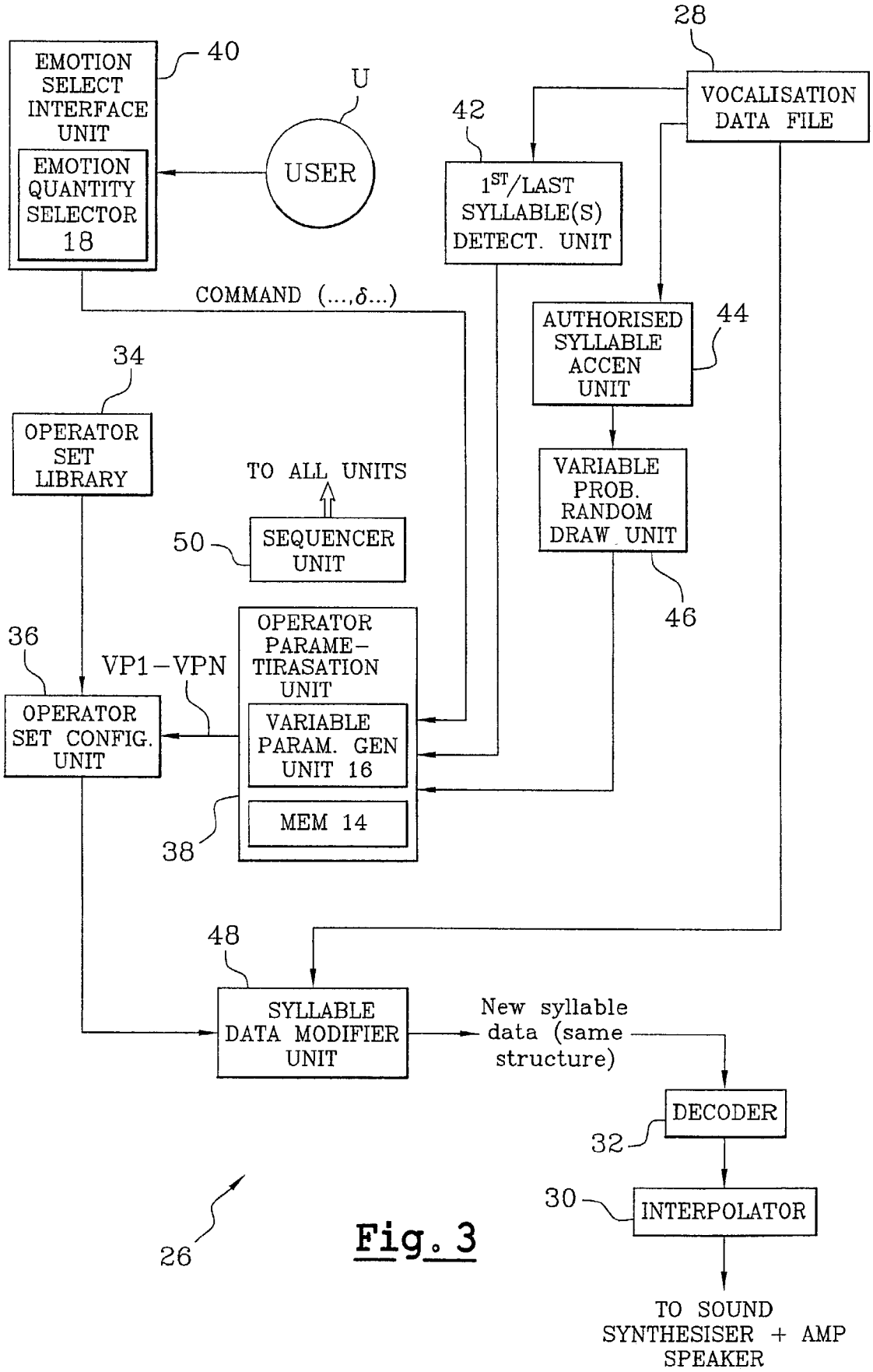
FIG. 3 is a block diagram of an example of an operator-based emotion generating system implementing the quantity of emotion variation system of FIG. 2.

FIG. 3 is a block diagram showing in functional terms how the emotion simulation algorithm system integrates with the above emotion synthesiser 26 to produce variable-intensity emotion-tinted voice data.

The emotion simulation algorithm system 26 operates by selectively applying the operators O on the syllable data read out from a vocalisation data file 28. Depending on their type, these operators can modify either the pitch data (pitch operator) or the syllable duration data (duration operator). These modifications take place upstream of an interpolator 30, e.g. before a voice data decoder 32, so that the interpolation is performed on the operator-modified values. As explained below, the modification is such as to transform selectively a neutral form of speech into a speech conveying a chosen emotion (sad, calm, happy, angry) in a chosen quantity.

The basic operator forms are stored in an operator set library 34, from which they can be selectively accessed by an operator set configuration unit 36. The latter serves to prepare and parameterise the operators in accordance with current requirements. To this end, there is provided an operator parameterisation unit 38 which determines the parameterisation of the operators in accordance with: i) the emotion to be imprinted on the voice (calm, sad, happy, angry, etc.), ii) the degree—or intensity—of the, emotion to apply, and iii) the context of the syllable, as explained below. For the implementation of the embodiment according to FIG. 2, the operation parameterisation unit 38 incorporates the variable parameter generator unit 16 and the memory 14 of the quantity of emotion variation system 10.

The emotion and degree of emotion are instructed to the operator parameterisation unit 38 by an emotion selection interface 40 which presents inputs accessible by a user U. For the implementation of the embodiment, this user interface incorporates the quantity of emotion selector 18 (cf. FIG. 2), the pointer 22 being a physically or electronically user-displaceable device. Accordingly, among the commands issued by the interface unit 40 will be the variable δ. The emotion selection interface 40 can be in the form of a computer interface with on-screen menus and icons, allowing the user U to indicate all the necessary emotion characteristics and other operating parameters.

In the example, the context of the syllable which is operator sensitive is: i) the position of syllable in a phrase, as some operator sets are applied only to the first and last syllables of the phrase, ii) whether the syllables relate to intelligible word sentences or to unintelligible sounds (babble, etc.) and iii) as the case arises, whether or not a syllable considered is allowed or not to be accentuated, as indicated in the vocalisation data file 28.

To this end, there is provided a first and last syllables identification unit 42 and an authorised syllable accentuation detection unit 44, both having an access to the vocalisation data file unit 28 and informing the operator parameterisation unit 38 of the appropriate context-sensitive parameters.

As detailed below, there are operator sets which are applicable specifically to syllables that are to be accentuated ("accentuable" syllables). These operators are not applied systematically to all accentuable syllables, but only to those chosen by a random selection among candidate syllables. The candidate syllables depend on the vocalisation data. If the latter contains indications of which syllables are allowed to be accentuated, then the candidate syllables are taken only among those accentuable syllables. This will usually be the case for intelligible texts, where some syllables are forbidden from accentuation to ensure a naturally-sounding delivery. If the vocalisation library does not contain such indications, then all the syllables are candidates for the random selection. This will usually be the case for unintelligible sounds.

The random selection is provided by a controllable probability random draw unit 46 operatively connected between the authorised syllable accentuation unit 44 and the operator parameterisation unit 38. The random draw unit 38 has a controllable degree of probability of selecting a syllable from the candidates. Specifically, if N is the probability of a candidate being selected, with N ranging controllably from 0 to 1, then for P candidate syllables, N.P syllables shall be selected on average for being subjected to a specific operator set associated to a random accentuation. The distribution of the randomly selected candidates is substantially uniform over the sequence of syllables.

The suitably configured operator sets from the operator set configuration unit 26 are sent to a syllable data modifier unit 48 where they operate on the syllable data. To this end, the syllable data modifier unit 48 receives the syllable data directly from the vocalisation data file 28. The thus-received syllable data are modified by unit 48 as a function of the operator set, notably in terms of pitch and duration data. The resulting modified syllable data (new syllable data) are then outputted by the syllable data modifier unit 48 to the decoder 32, with the same structure as presented in the vocalisation data file. In this way, the decoder can process the new syllable data exactly as if it originated directly from the vocalisation data file. From there, the new syllable data are interpolated (interpolator unit 30) and processed by an audio frequency sound processor, audio amplifier and speaker. However, the sound produced at the speaker then no longer corresponds to a neutral tone, but rather to the sound with a simulation of an emotion as defined by the user U.

All the above functional units are under the overall control of an operations sequencer unit 50 which governs the complete execution of the emotion generation procedure in accordance with a prescribed set of rules.

Figure 4:
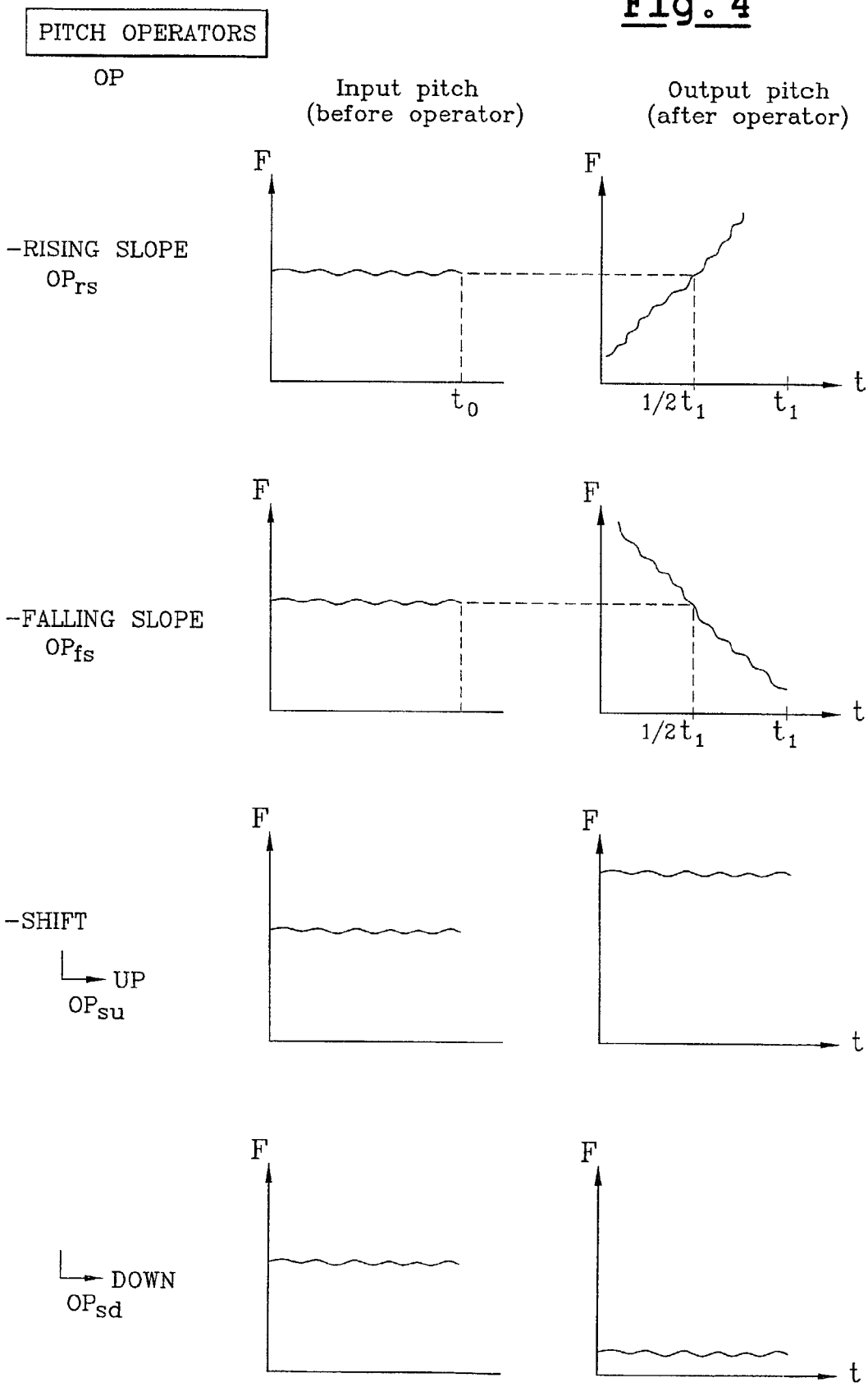
FIG. 4 is a diagrammatic representation of pitch operators used by the system of FIG. 3.

FIG. 4 illustrates graphically the effect of the pitch operator set OP on a pitch curve of a synthesized sound element originally specified by its sound data. For each operator, the figure shows—respectively on left and right columns—a pitch curve (fundamental frequency f against time t) before the action of the pitch operator and after the action of a pitch operator. In the example, the input pitch curves are identical for all operators and happen to be relatively flat.

There are four operators in the illustrated set, as follows (from top to bottom in the figure):

a "rising slope" pitch operator OPrs, which imposes a slope rising in time on any input pitch curve, i.e. it causes the original pitch contour to rise in frequency over time;

a "falling slope" pitch operator OPfs, which imposes a slope falling in time on any input pitch curve, i.e. it causes the original pitch contour to fall in frequency over time;

a "shift-up" pitch operator OPsu, which imposes a uniform upward shift in fundamental frequency on any input pitch curve, the shift being the same for all points in time, so that the pitch contour is simply moved up the fundamental frequency axis; and a "shift-down" pitch operator OPsd, which imposes a uniform downward shift in fundamental frequency on any input pitch curve, the shift being the same for all points in time, so that the pitch contour is simply moved down the fundamental frequency axis.

In the embodiment, the rising slope and falling slope operators OPrs and OPfs have the following characteristic: the pitch at the central point in time (½ t1 for a pitch duration of t1) remains substantially unchanged after the operator. In other words, the operators act to pivot the input pitch curve about the pitch value at the central point in time, so as to impose the required slope. This means that in the case of a rising slope operator OPrs, the pitch values before the central point in time are in fact lowered, and that in the case of a falling slope operator OPfs, the pitch values before the central point in time are in fact raised, as shown by the figure.

Figure 5:
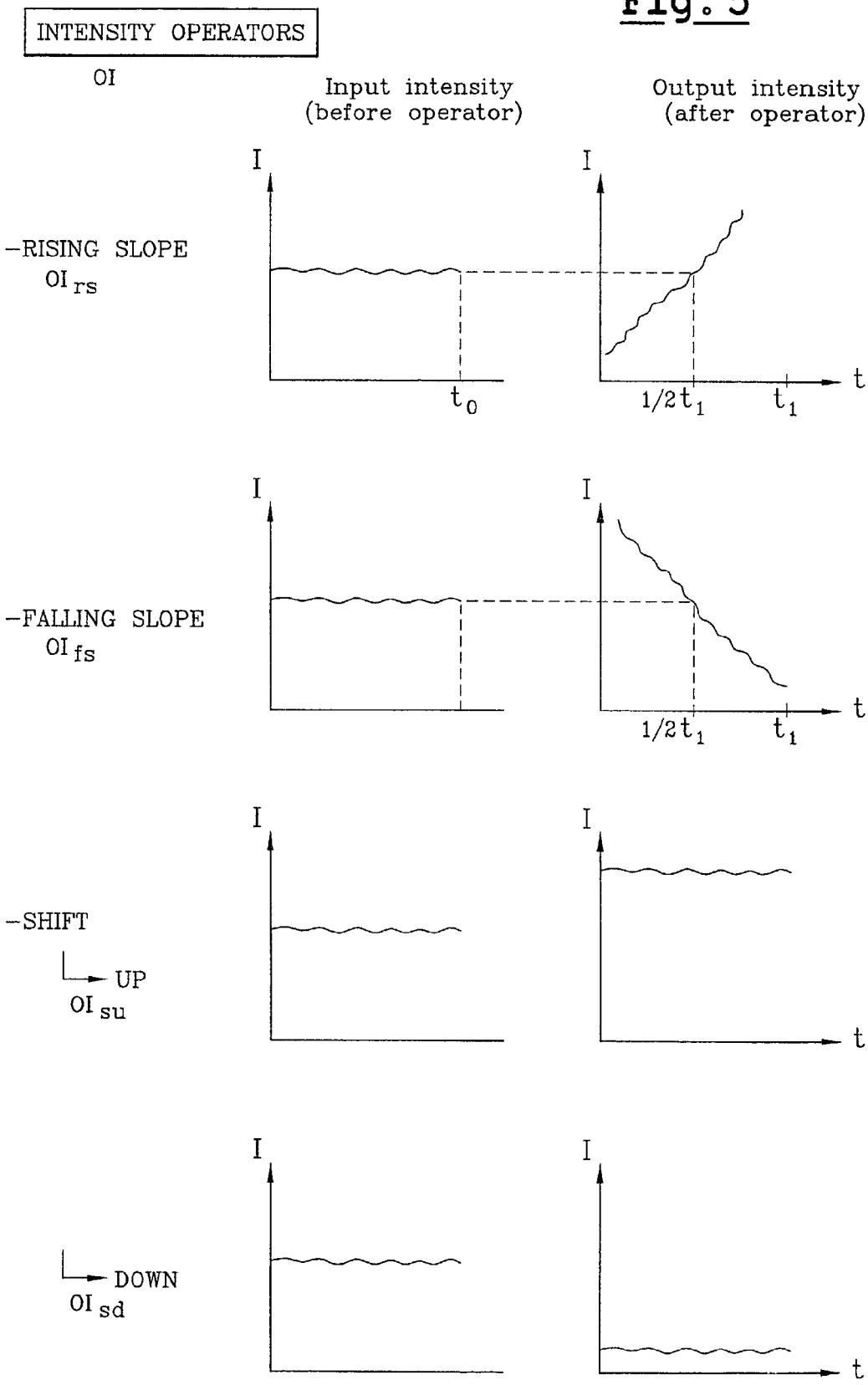
FIG. 5 is a diagrammatic representation of intensity operators which may optionally be used in the system of FIG. 3.

Optionally, there can also be provided intensity operators, designated OI. The effects of these operators are shown in FIG. 5, which is directly analogous to the illustration of FIG. 4. These operators are also four in number and are identical to those of the pitch operators OP, except that they act on the curve of intensity I over time t. Accordingly, these operators shall not be detailed separately, for the sake of conciseness.

The pitch and intensity operators can each be parameterised as; follows:

for the rising and falling operators (OPrs, OPfs, OIrs, OIfs):the gradient of slope to be imposed on the input contour. The slope can be expressed in terms of normalised slope values. For instance, 0 corresponds to no slope imposed: the operator in this case has no effect on the input (such an operator is referred to a neutralised, or neutral, operator). At the other extreme, a maximum value max causes the input curve to have an infinite gradient i.e. to rise or fall substantially vertically. Between these extremes, any arbitrary parameter value can be associated to the operator in question to impose the required slope on the input contour;

for the shift operators (OPsu, OPsd, OIsu, OIsd): the amount of shift up or down imposed on the input contour, in terms of absolute fundamental frequency (for pitch) or intensity value. The corresponding parameters can thus be expressed in terms of unit increments or decrements along the pitch or intensity axis.

Figure 6:
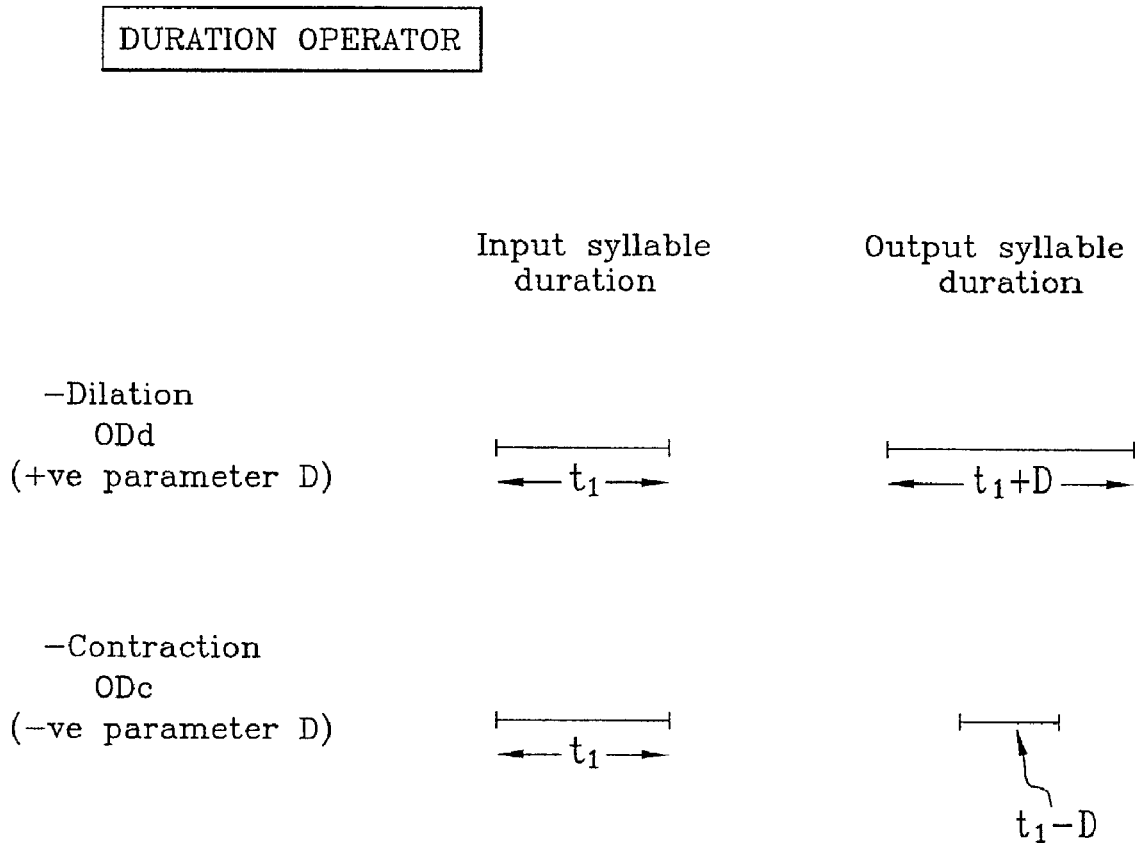
FIG. 6 is a diagrammatic representation of duration operators used by the system of FIG. 3, and FIGS. 7A and 7B form a flow chart of an emotion generating process performed on syllable data by the system of FIG. 3, FIG. 7B being a continuation of FIG. 7A.

FIG. 6 illustrates graphically the effect of a duration (or time) operator OD on a syllable. The illustration shows on left and right columns respectively the duration of the syllable (in terms of a horizontal line expressing an initial length of time t1) of the input syllable before the effect of a duration operator and after the effect of a duration operator.

The duration operator can be:

a dilation operator which causes the duration of the syllable to increase. The increase is expressed in terms of a parameter D, referred to as a positive D parameter). For instance, D can simply be a number of milliseconds of duration to add to the initial input duration value if the latter is also expressed in milliseconds, so that the action of the operator is obtained simply by adding the value D to duration specification t1 for the syllable in question. As a result, the processing of the data by the interpolator 30 and following units will cause the period over which the syllable is pronounced to be stretched;

a contraction operator which causes the duration of the syllable to increase. The decrease is expressed in terms of the same parameter D, being negative parameter in this case). For instance, D can simply be a number of milliseconds of duration to subtract from the initial input duration value if the latter is also expressed in milliseconds, so the action of the operator is obtained simply by subtracting the value D from the duration specification for the syllable in question. As a result, the processing of the data by the interpolator 30 and following units will cause the period over which the syllable is pronounced to be contracted (shortened).

The operator can also be neutralised or made as a neutral operator, simply by inserting the value 0 for the parameter D.

Note that while the duration operator has been represented as being of two different types, respectively dilation and contraction, it is clear that the only difference resides in the sign plus or minus placed before the parameter D. Thus, a same operator mechanism can produce both operator functions (dilation and contraction) if it can handle both positive and negative numbers.

The range of possible values for D and its possible incremental values in the range can be chosen according to requirements.

In what follows, the parameterisation of each of the operators OP, OI and OD is expressed by a variable value designated by the last letters of the specific operator plus the suffix specific to each operator, i.e.: Prs=value of the positive slope for rising slope pitch operator OPrs; Pfs=value of the negative slope for the falling slope pitch operator OPfs; Psu=value of the amount of upward shift for the shift-up pitch operator OPsu; Psd=value of the downward shift pitch operator OPsd;

Irs=value of the positive slope for rising slope intensity operator OIrs; Ifs=value of the negative slope for the falling slope intensity operator OIfs; Isu=value of the amount of upward shift for the shift-up intensity operator OIsu; Isd=value of the downward shift intensity operator Oisd; Dd=value of the time increment for the duration dilation operator ODd; Dc value of the time decrement (contraction) for the duration contraction operator ODc.

The embodiment further uses a separate operator, which establishes the probability N for the random draw unit 46. This value is selected from a range of 0 (no possibility of selection) to 1 (certainty of selection). The value N serves to control the density of accentuated syllables in the vocalised output as appropriate for the emotional quality to reproduce.

In the example, each or a selection of the above values that parameterise the operators OP, OI, OD and N is made variable by the variable parameter generator unit 16 operating in conjunction with the memory 14 and emotion quantity selector 18, as described with reference to FIG. 2. Thus, a given variable parameter VPi can correspond to one of the following above-defined parameter values to be made variable: Prs, Pfs, Psu, Psd, Irs, Ifs, Isu, Isd, Dd, Dc. The number and selection of these values to be made variable is selectable by the user interface 40.

Figure 7A:
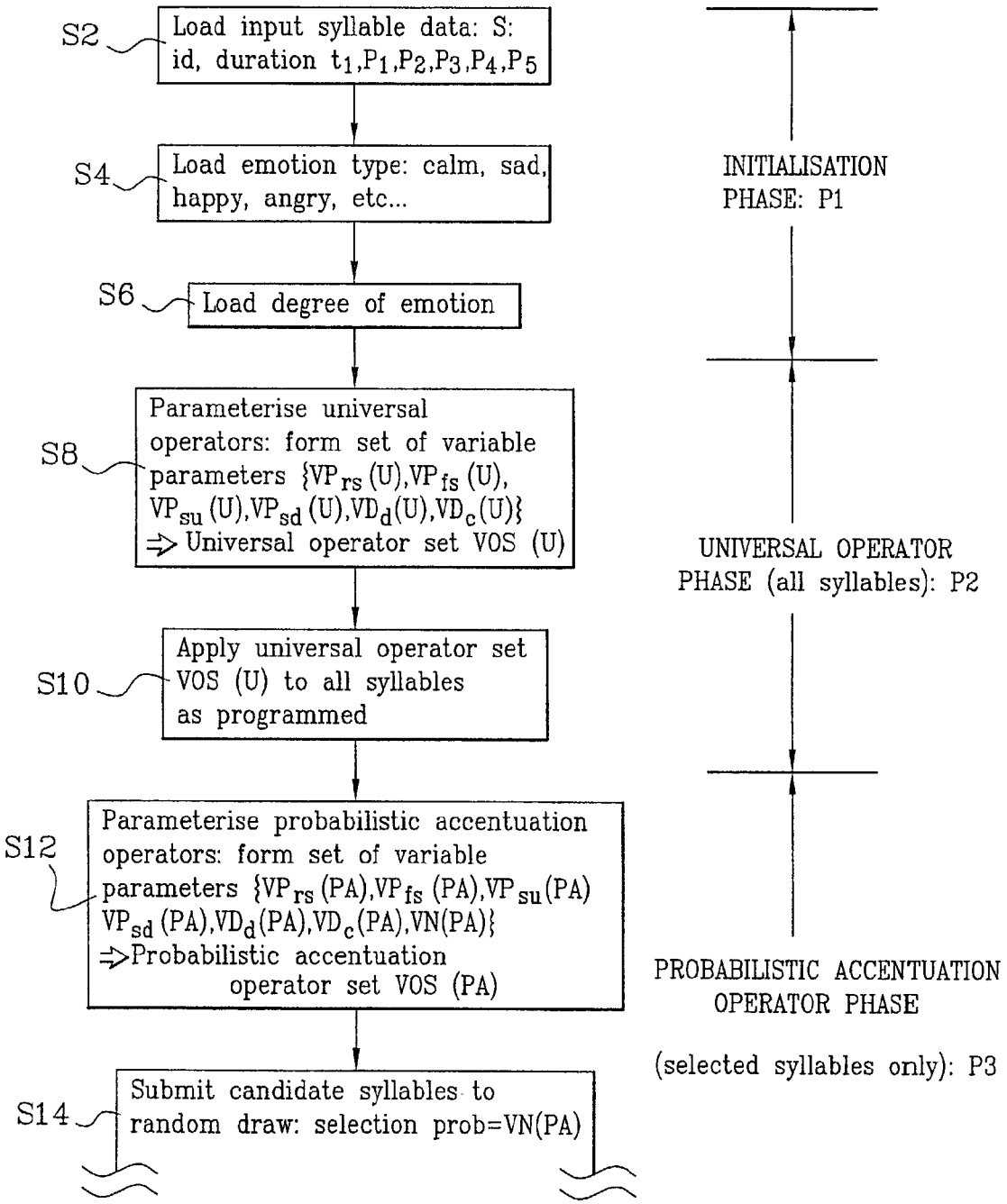
Figure 7B:
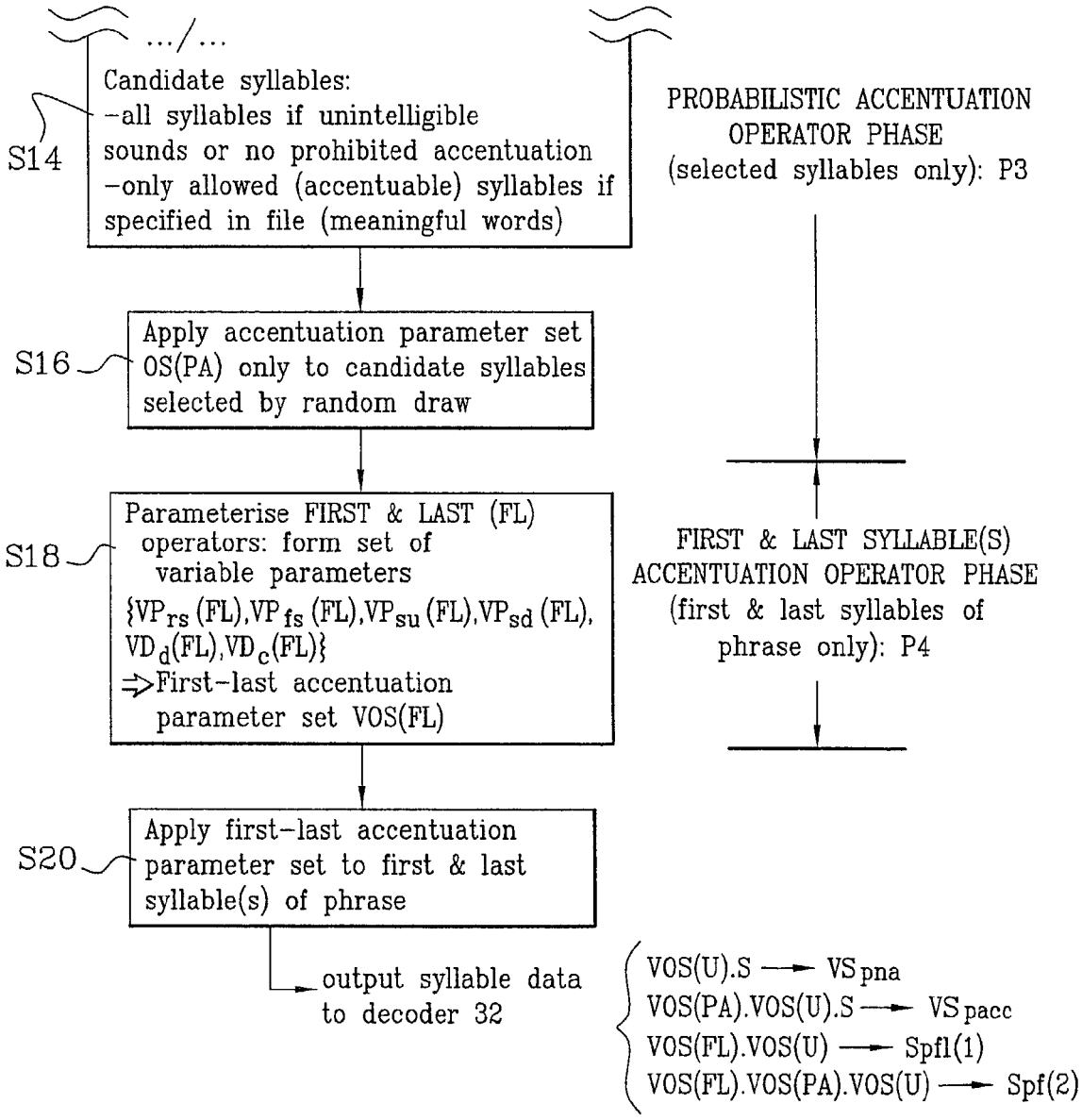

FIGS. 7A and 7B constitute a flow chart indicating the process of forming and applying selectively the above operators to syllable data on the basis of the system described with reference to FIG. 3. FIG. 7B is a continuation of FIG. 7A.

The process starts with an initialisation phase P1 which involves loading input syllable data from the vocalisation data file 28 (step S2).

Next is loaded the emotion to be conveyed on the phrase or passage of which the loaded syllable data forms a part, using the interface unit 40 (step S4). The emotions can be calm, sad, happy, angry, etc. The interface also inputs the quantity (degree) of emotion to be given, e.g. by attributing a weighting value (step S6). This weighting value is expressible as the excursion of the variable parameter value(s) VPi from the standard value Pi(=Ei), defined by the variable δ, as described with reference to FIG. 2.

The system then enters into a universal operator phase P2, in which a universal operator set OS(U) is applied systematically to all the syllables. The universal operator set OS(U) contains all the operators of FIGS. 4 and 6, i.e. OPrs, OPfs, OPsu, OPsd, forming the four pitch operators, plus ODd and ODc, forming the two duration operators. Each of these operators of operator set OS(U) is parameterised by a respective associated value, respectively Prs(U), Pfs(U), Psu(U), Psd(U), Dd(U), and Dc(U), as explained above (step S8). This step involves attributing numerical values to these parameters, and is performed by the operator set configuration unit 26. The choice of parameter values for the universal operator set OS(U) is determined by the operator parameterisation unit 8 as a function of the programmed emotion and quantity of emotion, plus other factors as the case arises. In the example, it shall be assumed that each of these parameters is made variable by the variable δ, whereupon they shall be designated respectively as VPrs(U), VPfs(U), VPsu(U), VPsd(U), VDd (U), and VDc(U). (Generally, in what follows, any parameter value or operator/operator set which is thus made variable by the variable δ is identified as such by the letter "V" placed as the initial letter of its designation.)

The universal operator set VOS(U) is then applied systematically to all the syllables of a phrase or group of phrases (step S10). The action involves modifying the numerical values t1, P1-P5 of the syllable data. For the pitch operators, the slope parameter VPrs or VPfs is translated into a group of five difference values to be applied arithmetically to the values P1-P5 respectively. These difference values are chosen to move each of the values P1 -P5 according to the parameterised slope, the middle value P3 remaining substantially unchanged, as explained earlier. For instance, the first two values of the rising slope parameters will be negative to cause the first half of the pitch to be lowered and the last two values will be positive to cause the last half of the pitch to be raised, so creating the rising slope articulated at the centre point in time, as shown in FIG. 6. The degree of slope forming the variable parameterisation is expressed in terms of these difference values. A similar approach in reverse is used for the falling slope parameter.

The shift up or shift down operators can be applied before or after the slope operators. They simply add or subtract a same value, determined by the parameterisation, to the five pitch values P1-P5. The operators form mutually exclusive pairs, i.e. a rising slope operator will not be applied if a falling slope operator is to be applied, and likewise for the shift up and down and duration operators.

The application of the operators (i.e. calculation to modify the data parameters t1, P1-P5) is performed by the syllable data modifier unit 48.

Once the syllables have thus been processed by the universal operator set VOS(U), they are provisionally buffered for further processing if necessary.

The system then enters into a probabilistic accentuation phase P2, for which another operator accentuation parameter set VOS(PA) is prepared. This operator set has the same operators as the universal operator set, but with different variable values for the parameterisation. Using the convention employed for the universal operator set, the operator set VOS(PA) is parameterised by respective values: VPrs(PA), VPfs(PA), VPsu(PA), VPsd(PA), VDd(PA), and VDc(PA). These parameter values are likewise calculated by the operator parameterisation unit 38 as a function of the emotion, degree of emotion and other factors provided by the interface unit 40. The choice of the parameters is generally made to add a degree of intonation (prosody) to the speech according to the emotion considered. An additional parameter of the probabilistic accentuation operator set VOS(PA) is the value of the probability N, as defined above, which is also made variable (VN) by the variable δ. This value depends on the emotion and degree of emotion, as well as other factors, e.g. the nature of the syllable file.

Once the parameters have been obtained, they are entered into the operator set configuration unit 26 to form the complete probabilistic accentuation parameter set VOS(PA) (step S12).

Next is determined which of the syllables is to be submitted to this operator set VOS(PA), as determined by the random unit 46 (step S14). The latter supplies the list of the randomly drawn syllables for accentuating by this operator set. As explained above, the candidate syllables are:

all syllables if dealing with unintelligible sounds or if there are no prohibited accentuations on syllables, or only the allowed (accentuable) syllables if these are specified in the file. This will usually be the case for meaningful words.

The randomly selected syllables among the candidates are then submitted for processing by the probabilistic accentuation operator set VOS(PA) by the syllable data modifier unit 48 (step S16). The actual processing performed is the same as explained above for the universal operator set, with the same technical considerations, the only difference being in the parameter values involved.

It will be noted that the processing by the probabilistic accentuation operator set VOS(PA) is performed on syllable data that have already been processed by the universal operator set VOS(U). Mathematically, this fact can be presented as follows, for a syllable data item Si of the file processed after having been drawn at step S14: VOS(PA).VOS(U). Si→Sipacc, where Sipacc is the resulting data for the accentuated processed syllable.

For all but the syllables of the first and last words of a phrase contained in the vocalisation data file unit 28, the syllable data modifier unit 48 will supply the following modified forms of the syllable data (generically denoted S) originally in the file 28:

VOS(U).S→Spna for the syllable data that have not been drawn at step S14, Spna designating a processed non-accentuated syllable, and VOS(PA).VOS(U). S→Spacc for the syllable data that have been drawn at step S14, Space designating a processed accentuated syllable.

Finally, the process enters into a phase P4 of processing an accentuation specific to the first and last syllables of a phrase. When a phrase is composed of identifiable words, this phase P4 acts to accentuate all the syllables of the first and last words of the phrase. The term phrase can be understood in the normal grammatical sense for intelligible text to be spoken, e.g. in terms of pauses in the recitation. In the case of unintelligible sound, such as babble or animal imitations, a phrase is understood in terms of a beginning and end of the utterance, marked by a pause. Typically, such a phrase can last from around one to three or four seconds. For unintelligible sounds, the phase P4 of accentuating the last syllables applies to at least the first and last syllables, and preferably the first m and last n syllables, where m or n are typically equal to around 2 or 3 and can be the same or different.

As in the previous phases, there is performed a specific parameterisation of the same basic operators VOPrs, VOPfs, VOPsu, VOPsd, VODd, VODc, yielding a first and last syllable accentuation operator set VOS(FL) parameterised by a respective associated value, respectively VPrs(FL), VPfs (FL), VPsu(FL), VPsd(FL), VDd(FL), and VDc(FL) (step S18). These parameter values are likewise calculated by the operator parameterisation unit 28 as a function of the emotion, degree of emotion and other factors provided by the interface unit 30.

The resulting operator set VOS(FL) is then applied to the first and last syllables of each phrase (step S20), these syllables being identified by the first/last syllables detector unit 34.

As above, the syllable data on which is applied operator set VOS(FL) will have previously been processed by the universal operator set VOS(U) at step S10. Additionally, it may happen that a first or last syllable(s) would also been drawn at the random selection step S14 and thereby also be processed with by probabilistic accentuation operator set VOS(PA).

There are thus two possibilities of processing for a first or last syllable, expressed below using the convention defined above:

possibility one: processing by operator set VOS(U) and then by operator set VOS(FL), giving: VOS(FL).VOS(U). S→Spfl(1), and possibility two: processing successively by operator set VOS(U), VOS PA) and VOS(FL), giving; VOS(FL).VOS (PA). VOS(U).S→Spfl(2).

This simple operator-based approach has been found to yield results at least comparable to those obtained by much more complicated systems, both for meaningless utterances and in speech in a recognisable language.

The choice of parameterisations to express a given emotion is extremely subjective and varies considerably depending on the form of utterance, language, etc. However, by virtue of having simple, well-defined parameters that do not require much real-time processing, it is a simple to scan through many possible combinations of parameterisations to obtain the most satisfying operator sets.

For each parameterisation, associated with a given emotion, there can be fixed a range of variability in parameter values in accordance with the invention which allows a control of the quantity of that emotion produced.

Merely to give an illustrative example, the Applicant has found the that good results can be obtained with the following parameterisations:

Sad: pitch for universal operator set=falling slope with small inclination duration operator=dilation probability of draw N for accentuation:low Calm: no operator set applied, or only lightly parameterised universal operator Happy: pitch for universal operator set=rising slope, moderately high inclination duration for universal operator set=contraction duration for accentuated operator set=dilation Angry: pitch for all operator sets=falling slope, moderately high inclination duration for all operator sets=contraction.

For an operator set not specified in the above example, the parameterisation of the same general type for all operator sets. Generally speaking, the type of changes (rising slope, contraction, etc.) is the same for all operator sets, only the actual values being different. Here, the values are usually chosen so that the least amount of change is produced by the universal operator set, and the largest amount of change is produced by the first and last syllable accentuation, the probabilistic accentuation operator set producing an intermediate amount of change.

The system can also be made to use intensity operators OI in its set, depending on the parameterisation used.

The interface unit 40 can be integrated into a computer interface to provide different controls. Among these can be direct choice of parameters of the different operator sets mentioned above, in order to allow the user U to fine-tune the system. The interface can be made user friendly by providing visual scales, showing e.g. graphically the slope values, shift values, contraction/dilation values for the different parameters.

The invention can cover many other types of emotion synthesis systems. While being particularly suitable for synthesis systems that convey an emotion on voice or sound, the invention can also be envisaged for other types of emotion synthesis systems, in which the emotion is conveyed on other forms: facial or body expressions, visual effects, etc., motion of animated objects where the parameters involved reflect a type of emotion to be conveyed.

The invention claimed is:

1. A method of controlling an operation of an emotion synthesizing device having a plurality of input speech prosodical parameters whose values VPi are used to set a type and intensity of emotion to be conveyed, comprising:

selecting a value of an emotion control variable δ within a predetermined interval; and determining the corresponding values VPi of each of the plurality of input parameters in accordance with the following formula:

$$VPi=Ai+\delta Bi,$$

wherein Ai and Bi are constant values defining a control range for the corresponding input parameter, thereby to confer a variability in the intensity of said type of emotion to be conveyed; and each VPi is varied only by varying δ.

2. The method according to claim 1, further comprising synthesizing the emotion to be conveyed by sound.

3. The method according to claim 1, wherein Ai is a value inside said control range, whereby the value of the emotion control variable δ is variable in the predetermined interval, which contains the value zero.

4. The method according to claim 3, wherein Ai is substantially the mid value of said control range, and the value of the emotion control variable δ is variable in the predetermined interval, whose mid value is zero.

5. The method according to claim 4, wherein said value of the emotion control variable is variable in the predetermined interval, which is −1 to +1.

6. The method according to claim 1, wherein Bi is determined by: Bi=(Eimax−Ai), or by Bi=(Eimin+Ai), wherein:

Eimax is a value of an input parameter for producing the maximum quantity of said type of emotion to be conveyed in said control range, and Eimin is a value of an input parameter for producing the minimum quantity of said type of emotion to be conveyed in said control range.

7. The method according to claim 1, wherein Ai is equal to a standard parameter value originally specified to set a type of emotion to be conveyed.

8. The method according to claim 6, wherein said value Eimax and said value Eimin are determined experimentally by varying the standard parameter value and by determining a maximum variation in the standard parameter value in an increasing or decreasing direction that yields a desired limit to the intensity of emotion to be conferred by said control range.

9. An apparatus for controlling an operation of an emotion synthesising system, the emotion synthesizing system having a plurality of input speech prosodical parameters whose values VPi are used to set a type and intensity of emotion to be conveyed, the apparatus comprising:

means for selecting a value of an emotion control variable δ within a predetermined interval;

variation means for determining the corresponding values VPi of each of said plurality of input parameters in accordance with the following formula:

$$VPi=Ai+\delta Bi,$$

wherein Ai and Bi are constant values defining a control range for the corresponding input parameter, thereby to confer a variability in the intensity of said type of emotion to be conveyed; and each VPi is varied only by varying δ.

10. The apparatus according to claim 9, wherein said value of the emotion control variable δ is variable in the predetermined interval, which contains the value zero.

11. The apparatus according to claim 10, wherein said value of the emotion control variable is variable in the predetermined interval, which is −1 to +1.

12. The apparatus according to claim 9, wherein said variation means causes said plurality of input parameters (VPi) to vary in response to the value of the emotion control variable according to one of the following formulas:

$$VPi=Emir+\delta.(Eimax-Emir), \text{ or}$$

$$VPi=Emir+\delta.(Eimin+Emr)$$

wherein

Emir is substantially the mid value of a control range, preferably equal to a standard parameter value originally specified to set a type of emotion to be conveyed, Eimax is a value of an input parameter for producing a maximum amount of said type of emotion to be conveyed in said control range, and Eimin is a value of an input parameter for producing a minimum amount of said type of emotion to be conveyed in said control range.

13. A method of using the apparatus according to claim 9 to adjust a quantity of emotion in a device for synthesising an emotion conveyed by sound.

14. A system comprising an emotion synthesis device having a plurality of inputs for receiving a corresponding plurality of parameters whose values are used to set a type and intensity of emotion to be conveyed; and an apparatus according to claim 9 operatively connected to deliver variables to said plurality of inputs, thereby to confer a variability in the intensity of a said type of emotion to be conveyed.

15. A computer readable medium having embedded therein a computer program, the computer program providing computer executable instructions, which, when loaded onto a data processor, causes the data processor to perform the method recited in claim 1.

* * * * *

UNITED STATES PATENT AND TRADEMARK OFFICE

CERTIFICATE OF CORRECTION

PATENT NO. : 7,457,752 B2
APPLICATION NO. : 10/217002
DATED : November 25, 2008
INVENTOR(S) : Pierre-Yves Oudeyer It is certified that error appears in the above-identified patent and that said Letters Patent is hereby corrected as shown below:

On the title page

Item [*] Notice: Subject to any disclaimer, the term of this patent is extended or adjusted under 35 USC 154(b) by (749) days Delete the phrase "by 749 days" and insert -- by 1,027 days --

Signed and Sealed this

Thirteenth Day of April, 2010

David J. Kappos

David J. Kappos
*Director of the United States Patent and Trademark Office*